US009631813B2

(12) United States Patent
Reinert et al.

(10) Patent No.: US 9,631,813 B2
(45) Date of Patent: Apr. 25, 2017

(54) INSERT ELEMENT FOR CLOSING AN OPENING INSIDE A WALL OF A HOT GAS PATH COMPONENT OF A GAS TURBINE AND METHOD FOR ENHANCING OPERATIONAL BEHAVIOUR OF A GAS TURBINE

(71) Applicant: ALSTOM Technology Ltd, Baden (CH)

(72) Inventors: Felix Reinert, Wettingen (CH); Guenter Ambrosy, Fislisbach (CH); Matthias Hoebel, Windisch (CH); Jeffrey De Jonge, Baden (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 432 days.

(21) Appl. No.: 14/087,569

(22) Filed: Nov. 22, 2013

(65) Prior Publication Data

US 2014/0147251 A1 May 29, 2014

(30) Foreign Application Priority Data

Nov. 23, 2012 (EP) ..... 12194025

(51) Int. Cl.
*F23R 3/00* (2006.01)
*F23R 3/04* (2006.01)

(52) U.S. Cl.
CPC ..... *F23R 3/007* (2013.01); *F23R 3/002* (2013.01); *F23R 2900/00005* (2013.01); *F23R 2900/00014* (2013.01); *Y10T 29/49318* (2015.01)

(58) Field of Classification Search
CPC .... F23R 3/002; F23R 3/04; F23R 3/06; F23R 3/007; F23R 2900/00019;
(Continued)

(56) References Cited

U.S. PATENT DOCUMENTS 3,981,142 A * 9/1976 Irwin ..... F23M 5/00 431/352
4,132,066 A * 1/1979 Austin, Jr. ..... F23R 3/06 60/752
(Continued)

FOREIGN PATENT DOCUMENTS

EP 0 669 500 8/1995
EP 1 666 795 6/2006
(Continued)

*Primary Examiner* — William H Rodriguez
(74) *Attorney, Agent, or Firm* — Buchanan Ingersoll & Rooney PC

(57) ABSTRACT

An insert element for closing an opening inside a wall of a hot gas path component of a gas turbine includes a plate like body with an opening sided surface. The surface provides at least one first area which projects beyond at least one second area of said surface which surrounds the at least one first area frame-like. The at least one first area is encompassed by a circumferential edge corresponding in form and size to the opening such that the circumferential edge and the opening contour limit a gap at least in some areas, while the at least one second area contacts directly or indirectly the wall of the hot gas path component at a rear side facing away from the hot gas path. The plate like body provides at least a first functional layer-system, providing at least one layer made of heat resistant material, defining the first area of the surface (S).

13 Claims, 2 Drawing Sheets

(58) Field of Classification Search
CPC .. F23R 2900/00014; F23R 3/045; F23R 3/10; Y10T 29/49318
USPC ..... 60/725, 759, 753, 752; 431/114; 244/1 N
See application file for complete search history.

(56) References Cited

U.S. PATENT DOCUMENTS

| | | | | | |
|---|---|---|---|---|---|
| 4,301,657 | A * | 11/1981 | Penny | F23R 3/12 | 60/748 |
| 4,315,405 | A * | 2/1982 | Pidcock | F23R 3/04 | 60/751 |
| 4,700,544 | A * | 10/1987 | Fucci | F23R 3/045 | 60/757 |
| 4,875,339 | A * | 10/1989 | Rasmussen | F23R 3/06 | 60/757 |
| 4,887,432 | A * | 12/1989 | Mumford | F23R 3/045 | 60/759 |
| 4,907,411 | A | 3/1990 | Krüeger | | |
| 5,235,805 | A * | 8/1993 | Barbier | F23R 3/26 | 60/39.23 |
| 5,331,816 | A * | 7/1994 | Able | F23R 3/007 | 60/752 |
| 5,488,829 | A * | 2/1996 | Southall | F23R 3/12 | 60/725 |
| 5,499,499 | A * | 3/1996 | Ambrogi | F23R 3/002 | 60/752 |
| 5,524,430 | A * | 6/1996 | Mazeaud | F23R 3/283 | 60/752 |
| 5,687,572 | A * | 11/1997 | Schrantz | F23R 3/007 | 431/352 |
| 6,331,110 | B1 * | 12/2001 | Steber | F01D 9/023 | 431/10 |
| 6,351,949 | B1 * | 3/2002 | Rice | F23R 3/007 | 403/316 |
| 6,494,044 | B1 * | 12/2002 | Bland | F01D 9/023 | 60/757 |
| 6,668,559 | B2 * | 12/2003 | Calvez | F23R 3/007 | 60/753 |
| 6,675,582 | B2 * | 1/2004 | Monty | F23R 3/08 | 60/752 |
| 7,216,485 | B2 * | 5/2007 | Caldwell | F23R 3/06 | 29/889.721 |
| 7,658,590 | B1 | 2/2010 | Spanks | | |
| 7,805,944 | B2 * | 10/2010 | Garry | F23R 3/06 | 60/752 |
| 2004/0083737 | A1 * | 5/2004 | Wright | F23R 3/005 | 60/773 |
| 2005/0229581 | A1 | 10/2005 | Bellucci et al. | | |
| 2008/0216481 | A1 * | 9/2008 | Pollarolo | F23R 3/50 | 60/725 |
| 2009/0084100 | A1 | 4/2009 | Johnson et al. | | |
| 2012/0017596 | A1 * | 1/2012 | Rudrapatna | F23R 3/06 | 60/752 |
| 2012/0047908 | A1 | 3/2012 | Poyyapakkam et al. | | |
| 2013/0031906 | A1 * | 2/2013 | DiCintio | F23R 3/045 | 60/737 |
| 2013/0213047 | A1 * | 8/2013 | Desai | F23R 3/002 | 60/752 |
| 2013/0336794 | A1 * | 12/2013 | Armstrong | F01D 9/00 | 416/189 |
| 2014/0007580 | A1 * | 1/2014 | Richardson | F23R 3/02 | 60/754 |
| 2014/0144146 | A1 * | 5/2014 | Penz | F23R 3/007 | 60/753 |
| 2015/0362190 | A1 * | 12/2015 | Taylor | F23R 3/002 | 60/752 |
| 2016/0123171 | A1 * | 5/2016 | Westphal | F01D 11/08 | 415/173.1 |

FOREIGN PATENT DOCUMENTS

| | | |
|---|---|---|
| EP | 2 017 826 | 1/2009 |
| EP | 2 295 864 | 3/2011 |
| EP | 2 397 759 | 12/2011 |

* cited by examiner

INSERT ELEMENT FOR CLOSING AN OPENING INSIDE A WALL OF A HOT GAS PATH COMPONENT OF A GAS TURBINE AND METHOD FOR ENHANCING OPERATIONAL BEHAVIOUR OF A GAS TURBINE

CROSS-REFERENCE TO RELATED APPLICATIONS

This application claims priority to European application 12194025.8 filed Nov. 23, 2012, the contents of which are hereby incorporated in its entirety.

TECHNICAL FIELD

The present invention relates to an insert element for closing an opening inside a wall of a hot gas path component of a gas turbine and method for enhancing operational behaviour of a gas turbine.

BACKGROUND

In order to increase the efficiency and power output of modern gas turbines, the combustion temperatures have been constantly raised. More recently, $NO_x$ and $CO_2$ emissions regulations have become stricter, maintaining low emission level will thus be an incentive of increasing importance. This can be addressed by reducing the unmixed air in the combustion process. While reducing the amount of effusion cooling air downstream the fuel injection location helps reducing emissions, the cooling of the hot gas path walls remains important for ensuring the specified operation lifetime. As an alternative to conventional effusion cooling, as disclosed in US 2012/0047908 A1, highly efficient near wall cooling schemes can provide the required cooling of the burner structure.

A combustion chamber with a combustion-chamber wall of double-walled design mentioned above emerges from EP 0 669 500 B1. There is a flow of compressed combustion feed air for cooling purposes through the enclosed intermediate space of the combustion-chamber wall of double-walled design which surrounds the combustion zone, the combustion-chamber wall of double-walled design being cooled by way of convective cooling. At the same time, this approach minimizes the amount of cooling air emitted into the hot gas path; unfortunately the manufacturing of such near wall cooling systems is very difficult. One approach could be the casting of double-walled hollow core structures. However, the drawback of this manufacturing method is its high complexity resulting in a high scrap rate and thus high cost. In addition, the casting approach suffers from its inherent design limitations and the very long lead-time for any design modification. Another problem is the large size and complexity of burner arrangement especially premix burner arranged along an annular shaped front panel of an annular combustor. Precision casting of double-wall, hollow core structures is normally reserved for smaller components like turbine blades and vanes, where a high prize can be easier accepted.

Another important aspect of operational behaviour of a gas turbine concerns operation flexibility. Here, the main limitations are pulsation levels during part load or transients, which have to be carefully controlled. In gas turbines, during operation, heavy thermo acoustic pulsations, which are heavy pressure oscillations, can occur in the combustion chamber, because of an incorrect combustion of the fuel such as gas or oil. These pulsations subject the hardware of the combustion device and the turbine to heavy mechanical vibrations that can result in the damage of individual parts of the combustion device or turbine.

In order to absorb such pulsations, combustion devices are usually provided with dampers, such as the Helmholtz dampers. Helmholtz dampers consist of a resonance chamber that is connected via a damping tube to the interior of the combustion chamber or the medium surrounding the combustion chamber.

US2005/0229581 discloses a reheat combustion device that has a mixing tube followed by a combustion chamber; the mixing tube has at its front panel an acoustic screen provided with holes and, parallel to it, an impingement plate also provided with holes. The acoustic screen and the impingement plate define a chamber connected to the inner of the combustion chamber via the holes of the acoustic screen and to the outer of the combustion chamber via the holes of the impingement plate. The chamber between the impingement plate and acoustic screen defines a plurality of Helmholtz dampers such that, since a plurality of dampers are associated to each reheat combustion device, the damping effect is improved. However the air flow within the chamber between the impingement plate and the acoustic screen is not guided, the cooling efficiency is not optimised; this makes different parts of the combustion chamber to be cooled in different way and to operate at different temperatures. In addition, manufacturing is very hard.

Another approach for reducing thermo acoustic pulsation efficiently concerns the combination of acoustic damping and near wall cooling as disclosed in EP 2 295 864 A1. Here a combustion device for a gas turbine comprises a portion having a first and a second wall. A first passage connects the zone between the first and second wall to the inner of the combustion device and a second passage connects said zone between the first and second wall to the outer of the combustion device. Between the first and second wall a plurality of chambers as being Helmholtz dampers are defined, each connected with one first passage and at least one second passage.

In the production of a prototype of a gas turbine the front panel of an annular combustor operated with a multitude of burners was manufactured as one full size part. After brazing the complete front panel sandwich structure enclosing the before described Helmholtz damper chambers, the front panel was hand-welded to the body of the annular combustion chamber. The procedure has been found to be rather complicate; in addition the welding area will be exposed to very high temperatures during operation of the gas turbine, so that life expectancy of this welding joint appears rather limited. Moreover, best engineering practice and much care was used for vacuum brazing of the large front panel prototype structure. It will be very difficult to maintain this manufacturing quality level in a commercial production process with a much higher volume of parts.

SUMMARY

It is a general object of the present invention to provide a generic concept allowing reliable interventions in a gas turbine to enhance operational behavior especially to improve heat resistance of heat exposed components of the gas turbine for reaching higher process temperatures. A further aspect is to lay the foundations for reducing acoustic pulsations in a gas turbine preferably at locations inside the hot gas path at which maximum amplitudes occur. This aspect however is hard to achieve due to the fact that the before mentioned locations can not be located exactly in advance, so that suitable interventions can not be provided during production of the gas turbine. Therefore the measures to be taken for the before mentioned purposes should also be applicable at already existing gas turbines.

The generic idea of the invention leaves the commonly concept of fabrication a gas turbine including all components for cooling and damping purposes before the gas turbine is put into operation. Rather the invention follows a generic concept allowing a reliable and modular manufacture of functional insert elements and their joining to the structure of pre-fabricated hot gas components of a gas turbine arrangement. A functional insert element has at least an enhanced function of heat resistance, preferably combined with a cooling function. In a more advanced manner the multi functional insert element can be combined with a damping function which will be described in more detail later on.

The inventive functional insert element can be manufactured in a separate process with respect to the manufacture of hot gas path components for the gas turbine and the joining concept for joining the functional insert element with hot gas path components of the gas turbine allows safe operation, future reconditioning and even the retrofit of already existing gas turbines, especially burners operated in a second stage of a sequential operated gas turbine arrangement.

The invention concerns a functional insert element for closing an opening inside a wall of a hot gas path component of a gas turbine which comprises a plate like body with an opening sided surface which provides at least one first area which projects beyond at least one second area of said surface which surrounds the at least one first area frame-like. The at least one first area is encompassed by a circumferential edge corresponding in form and size to said opening such that the circumferential edge and the opening contour limit a gap at least in some areas along the circumferential edge while the at least one second area contacts directly or indirectly the wall of the hot gas path component at a rear side facing away from the hot gas path. For purpose of improved heat resistance the plate like body provides at least a first functional layer-system, providing at least one layer of heat resistant material preferably made of thermal barrier coating (TBC), defining the first area of the surface.

For cooling purpose the plate like body further provides at least a second functional layer-system, being in direct or indirect flatly contact to said first layer-system at a side facing away from the first area and includes means for cooling the first layer-system.

The inventive insert element which in a preferred embodiment provides a thermal resistant and cooling function can be inserted into an opening of a wall of a hot gas component which is a machined aperture at a location at which the hot gas path component is exposed to excessive heat. The shape and size of the opening which is manufactured in the wall of the hot gas path component depend of local conditions such as geometrical shape and size of the component itself as well mechanical and thermal loads on the component during operation of the gas turbine.

For an effective cooling the second layer system of the insert element comprises at least one layer made of heat resistant material providing at least one cooling channel as means for cooling the first layer-system. The cooling channel can be drilled inside the at least one layer but also be realized as a one side open notch within the at least one layer. To close the notch air tightly the at least one layer joins the first layer-system directly or indirectly at the side facing away the second area.

In another embodiment the second layer-system may comprise at least two layers made of heat resistant material, each layer provides at least one through holes which are arranged such that the at least two through holes are fluidly connected so that cooling medium, like cooling air, flows through the connected holes of each layer.

In a further preferred embodiment of the inventive insert element the heat resistant and cooling function of the insert element is combined with a mechanism for acoustical damping of pulsations which occur inside the hot gas path of a gas turbine. For this the insert element provides a third layer-system being in direct or indirect flatly contact to said second layer-system at a side facing from the first layer-system and including means for acoustical damping having at least one acoustic access to the hot gas path. In one embodiment the means for acoustical dumping is a Helmholtz damper being defined by at least one cavity inside the third layer-system having direct access to the hot gas path through at least one hollow channel having a channel opening at the first area of the surface and merges into the cavity. The third layer-system may consist of just only one single layer made of heat resistant material including at least one cavity as described before but may also provide more than one layer which are stacked together sandwich like by brazing to enclose one or more acoustic sensible cavities or chambers having direct access to the hot gas path for acoustical damping purpose.

The plate like body of the inventive insert element is prefabricated by brazing the several layer-systems as described before, each made of high temperatures super alloy material, into one functional part. The insert element can have any geometrical shape and it can be custom tailored to the specific location and requirements of the hot gas path component. The thermal resistant material of each of the layers or layer-systems does not have to be made of the same material as the main structure of the hot gas path component. Also it is possible to use different heat resistant material in the several layer-systems or layers. The choice of the heat resistant material depends on weldability, better material properties concerning thermal conductivity, mechanical robustness etc.

Basically the insert element can be combined with further functional layer systems for example providing layers made of metallic foam, or ceramic inserts.

One of the main ideas of the inventive insert element concerns the design of the element such that the insert element can be inserted from outside of the hot gas path component which means from the colder, high-pressure side into the machined aperture of the hot gas path component: Hereto the insert element is centered relative to the machined opening in the wall of the hot gas path component at the outside of the component by facing the surface including the at least first and second area of the insert element towards the opening. The at least one first area is inserted into the opening while the at least one second area of the surface of the insert element get in direct or indirect contact with area of the outside wall of the hot gas path component surrounding the opening directly. While the pressure gradient and the design of the insert element help to keep the insert element at the desired location, a high energy beam weld stabilizes and seals the insert element in region of the second area and the wall of the hot gas path component.

The insert element basically enables to retrofit existing gas turbine arrangements which show areas of overheating and thermal acoustic pulsations. To enhance the operational behavior of such a gas turbine in a first step an opening may be provided into the wall of said hot gas path component at a location of high thermal and or mechanical stress. In a preferred manner the opening can be manufactured by cutting or drilling. Thereafter the insert element as described before is to be inserted from outside of said hot gas path component into the opening inside the wall of the hot gas path component. Finally the insert element will be fixed and sealed to said wall of the hot gas path component by means of welding or brazing.

BRIEF DESCRIPTION OF THE FIGURES

The invention shall subsequently be explained in more detail based on exemplary embodiments in conjunction with the drawings. The drawing

DETAILED DESCRIPTION

Figure 1A:
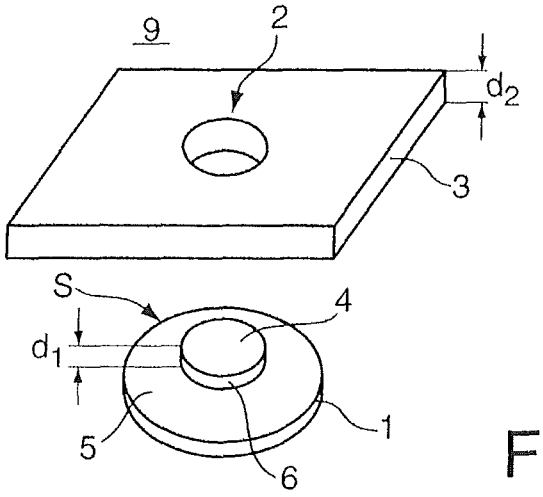
FIG. 1*a-d* shows a perspective view as well schematically longitudinal section views of the insert element for insertion into an opening of a wall of a hot gas path component, FIG. 2*a, b* shows a schematically longitudinal section view through a front panel of a combustor with a welded insert element in an opening of the front panel.

FIG. 1*a* shows a perspective view onto a section of a wall of a hot gas path component 3 in which an opening 2 is provided for example by means of drilling leading to an opening with a round opening contour. It is assumed that the visible surface of the hot gas path component 3 in the figure faces to the hot gas path 9 which is surrounded by the hot gas path component 3 completely.

Further an insert element 1 is provided having a surface S which is visible in FIG. 1*a* providing a first area 4 which is encompassed by a circumferential edge 6, and a second area 5. The first area 4 is to be raised relative to the second area 5 to a distance d1 which corresponds preferably to the depth d2 of the opening 2 of the hot gas path component 3 which is the wall thickness of the component 3 at least in the region of the opening 2.

The second area 5 of the surface S of the insert element 1 surrounds the first area collar- or frame-like and is adapted to the outer surface of the component 3 which is not visible in the perspective view of FIG. 1*a*.

Figure 1B:
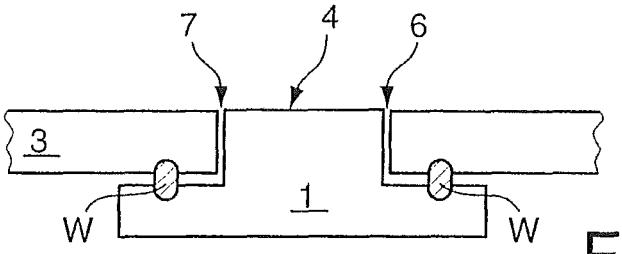

For closing the opening 2 of the hot gas path component 3 the insert element 1 is centered from outside of the component 3 relative to the opening 2 so that the first area 4 can be moved into the opening 2 till the first area 4 is flush with the inner surface of the wall of the component 3 like it is illustrated in FIG. 1*b*. In this situation the second area 5 of the insert element 1 contacts the outer surface of the component 3. The circumferential edge 6 limits a gap 7 together with the inner wall of the opening 2 as it can be derived of FIG. 1*b*. The dimension of the width of the gap 7 can be varied on demand and can range from zero to several millimeters or centimeters.

For fixation and sealing purpose the insert element 1 is welded to the outer surface of the wall of the hot gas path component 3 in region W of the second area 5.

Figure 1C:
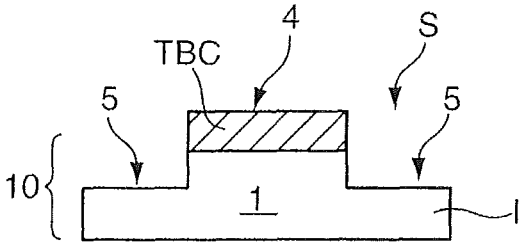

FIG. 1*c* shows a schematically longitudinal section view of the insert element 1 which provides a plate like body having the surface S providing the first and second area (4,5). The plate like body of the insert element 1 provides the first functional layer-system 10 which in case of FIG. 1*c* is a layer of heat resistant material, preferably a thermal barrier coating (TBC) defining the first area 4. The TBC-layer is directly bonded to a further heat resistant layer I. So the insert element 1 shown in the FIG. 1*c* provides thermal resistance function only.

Figure 1D:
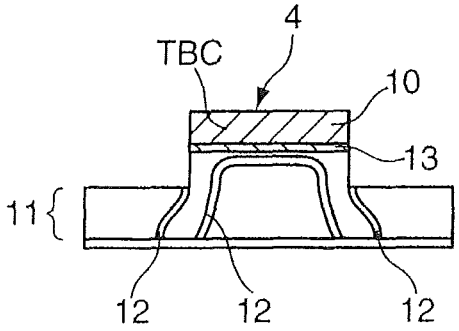

The embodiment shown in FIG. 1*d* has additional to the heat resistant properties a cooling function. Like in case of embodiment shown FIG. 1*c*, a TBC-layer defines the first functional layer-system 10. A second layer-system 11 is bonded to the first layer-system 10 at the rear side facing away from the first area 4 by a heat and oxidation resistant bond coat layer 13. The second layer-system 11 provides at least one cooling channel 12 through which a cooling medium, preferably cooling air is fed very close to the first layer-system 10 for a cooling purpose. To close the open cooling channels 12 at the rear side of the second layer-system 11 a final heat and oxidation resistant bond coat layer 13 is coated flatly onto the rear side.

Basically the number, shape and size of the openings 2 inside the wall the hot gas path component 3 can vary according to the functional needs of the component 3. In new designed hot gas path components openings 2 could already included in the casting mold, whereas for retrofit purpose of existing gas turbines it is possible to machine the openings at desired locations by well known techniques like CNC-milling, laser or water jet tatting and/or EBM to name a few.

The design of the insert element 1 has to be adapted to the shape and size of the opening 2 inside the hot gas path component 3 to ensure a possible self locking of the insert element 1 inside the opening 2. Also the insert element 1 shall include adequate smooth radii to avoid any notching effects. For an optimum joining quality a 3D scanning method could be used to ensure optimum fit of the insert element 1 in the pre-machined opening. In such a case a small adaptive machining operation of the joint surface would be included which uses the result of the 3D inspection.

Figure 2A:
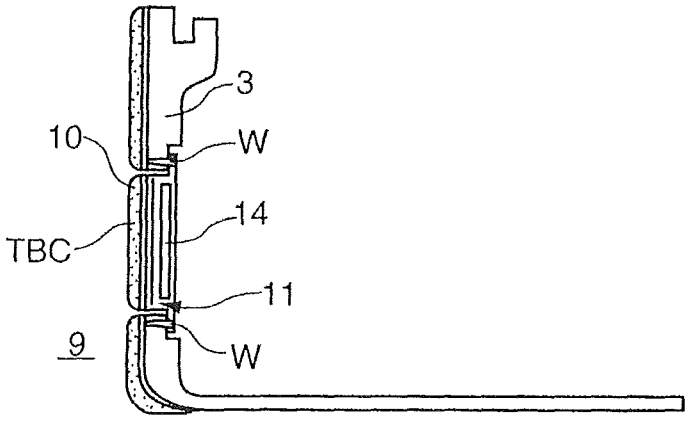

The embodiment shown in FIG. 2*a* shows a detailed view of an insert element 1 having the same thickness as the base material of the hot gas flow component 3, allowing the insert element 1 to be inserted flush with a front and back side of the hot gas path element 3. The insert element 3 provides a TBC layer as first layer-system 10 facing towards the hot gas path 9 which is surrounded by the hot gas path component 3. The TBC layer is followed by the second layer-system 11 which is bonded to the rear side of the TBC layer having cooling means 12 for cooling the TBC layer. The second layer-system 11 is also called as near wall cooling system to ensure, that the insert element 1 is actively cooled by cooling medium which is fed into the insert element 1 not shown in FIG. 2*a*. Further at the rear side of the second layer-system 11 a third layer-system 14 is provided which acts as an acoustic damping system to damp acoustical pulsation, which occur inside the hot gas path 9. The insert element is air tightly fixed at the hot has path component 3 by a weld seam w.

Figure 2B:
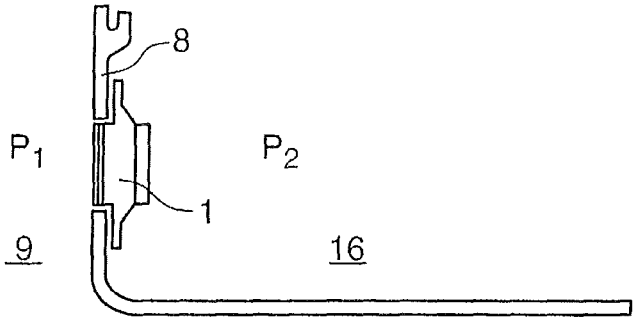

FIG. 2*b* shows a schematically longitudinal section view through an insert element 1 and a front panel structure 8 of a combustor of a gas turbine. Due to a pressure gradient between the hot gas path 9 with pressure p1 and the region of the plenum 16 with pressure p2 being greater than p1 the insert element 1 is self locked in position within the opening 2 inside the wall of the front panel structure 8. In difference to the embodiment shown in FIG. 2*a* the insert element 1 provides a thicker plate like body which is structured in many layers, not shown, each of the layer provide different technical function like cooling, acoustical damping, thermal resistance or absorbing mechanical vibrations for example by using layers of metal foam or other suitable materials.

The insert element 1 is to be inserted from the cooler and high-pressure side (p2) into the machined aperture of the front panel structure 8.

Figure 3:
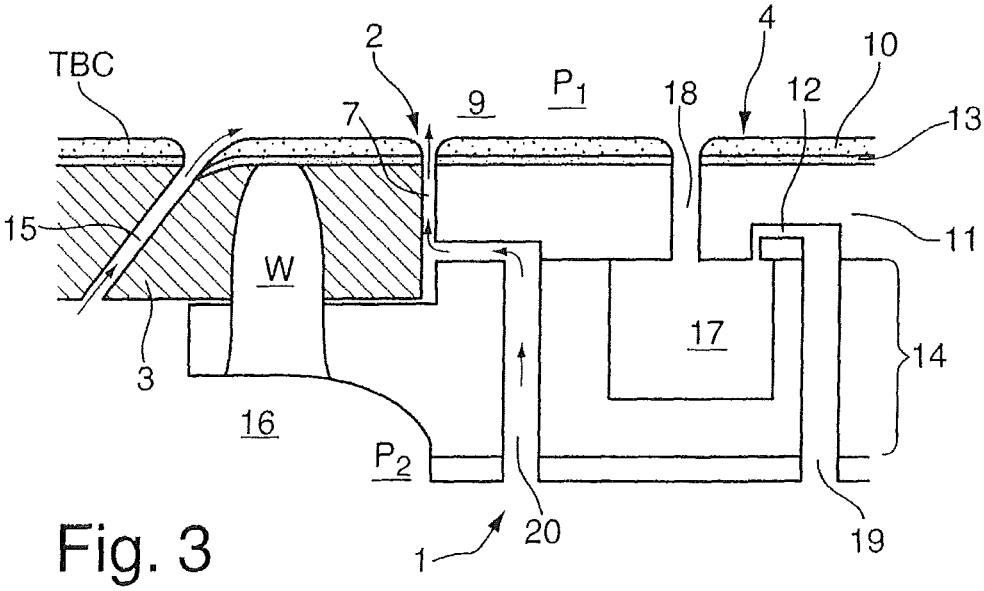
FIG. 3 shows schematically longitudinal section view through an insert element welded at a wall of a hot gas path component closing opening providing cooling and damping functions.

FIG. 3 shows a schematically longitudinal section view through an insert element 1 providing cooling and damping functions as mentioned briefly in connection with FIG. 2*a*. FIG. 3 shows a hot gas path component 3 which is coated with a layer of TBC on its inner surface facing the hot gas path 9. The hot gas path component 3 provides an opening 2 into which an insert element 1 is already inserted. FIG. 3 shows only a longitudinal section view of a part of the insert element 1. The insert element 1 is fixed and sealed at the wall of the hot gas path component 3 by weld seam W. The weld seam W extends between component 3 and insert element 1 which is additionally cooled by a cooling channel 15 passing through the wall of the hot gas path component 3.

At the outer side of the hot gas path component 3 the atmospheric environment of the plenum 16 prevails a pressure p2 which is typically higher than the operational pressure p1 inside the hot gas path 9. This pressure gradient ensures an inflow of cooling air from the plenum 16 through the channel 14 into the hot gas path 9. Further the pressure gradient ensures that the insert element 1 is pressed against the rear side of the wall of the hot gas path component 3 so that the insert element 1 is self fixed onto the outer wall of the hot gas path component 3 by closing the opening 2.

Further the insert element 1 provides as noted before a first layer-system 10 made of TBC material providing the first area 4 which is flush with the inner wall of the hot gas path component 3. At the rear side of the first layer-system 10 a bond coat layer 13 connects the second layer-system 11 including cooling channels 12 for cooling the first layer-system 11 exposed directly to hot gases. A third layer-system 14 is attached at the rear side of the second layer-system 11. The third layer-system 14 provides at least one cavity 17 for damping purpose which has at least acoustic access via a channel 18 which opens at the first area 4 of the first layer-system 11. Cavity 17 and channel 18 forming a Helmholtz resonator are designed in shape and size such that a maximum of pulsation energy can be absorbed by Helmholtz resonator. To avoid any ingestion of hot gases into channel 18 cavity 17 is joined with a supply channel 19 through which cooling air is fed into cavity 17 for blowing out through channel 18 into the hot gas path 9.

Additional cooling channels 20 are provided to feed cooling air from the plenum 16 into the gap 7.

As described before and can be seen from the embodiment shown in FIG. 3 the insert element 1 is coated with a thermal barrier coating TBC for thermal isolation. Depending on the weld requirements the complete coating of the insert element 1 and the inner wall of the hot gas path component 3 could be done prior or after to the joining. To remain the small gap 7 between the insert element 1 and the hot gas path component 3 while the coating is done after inserting the insert element 1 into the opening 2, the gap 7 can be maintained during the coating by appropriate masking techniques. The masking material can be removed after the coating by a heat treatment in a conventional fairness.

The invention claimed is:

1. An insert element for closing an opening inside a wall of a hot gas path component of a gas turbine, the insert comprising:

a disc body with a surface (S) configured to face the opening, said surface provides at least one first area which projects in a direction perpendicular to the surface beyond at least one second area of said surface, the at least one second area framing the at least one first area, the at least one first area is encompassed by a circumferential edge corresponding in form and size to said opening such that the circumferential edge and the opening contour limit a gap at least in some areas while the at least one second area contacts directly or indirectly the wall of the hot gas path component at a rear side facing away from the hot gas path, and the disc body includes a first functional layer-system, including at least one layer made of heat resistant material, defining the first area of the surface (S) as planar.

2. The insert element according to claim 1, wherein the at least one layer of heat resistant material is made of a thermal barrier coating (TBC).

3. The insert element according to claim 1, wherein a second layer-system being in direct or indirect flatly contact to said first layer-system at a side facing away from the first area and includes means for cooling the first layer-system.

4. The insert element according to claim 1, wherein the first layer-system is fixed to the second layer-system by a heat and oxidation resistant bond coat layer.

5. The insert element according to claim 3, wherein the second layer-system comprises at least one layer made of heat resistant material providing at least one cooling channel for cooling the first layer-system.

6. The insert element according to claim 5, wherein the second layer-system comprises at least two layers made of heat resistant material each layer providing at least one through hole, which are arranged such that the at least two through holes are fluidly connected.

7. The insert element according to claim 3, wherein a third layer-system system being in direct or indirect flatly contact to said second layer-system at a side facing away from the first layer-system and including an acoustical damper having at least one acoustic access to the hot gas path.

8. The insert element according to claim 7, wherein the acoustical damper is a Helmholtz damper being defined by at least one cavity inside the third layer-system having direct access to the hot gas path by at least one hollow channel, having a channel opening at the first area of the surface and merges into the cavity.

9. The insert element according to claim 1, wherein the at least one first area of the disc body is formed and arranged in relation to the at least one second area such that the surface of the at least one first area is arranged in the opening and flush with the wall of the hot gas path component while the at least one first area of the disc body closes the opening of the hot gas path component and the at least one second area faces the rear side of the wall.

10. The insert element according to claim 1, wherein the hot gas path component is a wall enclosing the combustor and/or the hot gas path which adjoins the combustor of the gas turbine.

11. The insert element according to claim 1, wherein the opening is a machined aperture which opening contour is adapted to the circumferential edge of the at least one first area of the surface (S) of the disc body.

12. Method for enhancing operational behavior of a gas turbine having a hot gas path component encircling at least parts of a combustor and/or a hot gas path adjoining to said combustor, comprising:

providing an opening into the wall of said hot gas path component at a location of high thermal and/or mechanical stress, inserting the insert element according to claim 1 from outside of said hot gas path component into the opening inside the wall of the a hot gas path component and fixing and sealing the insert element to said wall by welding and/or brazing.

13. Method according to claim 12, wherein said opening being provided during production process of the hot gas path component by molding or as part of a post-processing at the wall of the hot gas path component by a cutting and/or drilling process.

* * * * *